United States Patent [19]

Malasek et al.

[11] 4,178,971

[45] Dec. 18, 1979

[54] METHOD OF AND APPARATUS FOR INSERTING WEFT THREADS INTO A JET LOOM

[75] Inventors: Jaromir Malasek, Brno; Vladimir Kuda, Blazovice; Miroslav Bucek, Brnenske Ivanovice, all of Czechoslovakia

[73] Assignee: Vyzkumny a vyvojovy ustav Zavodu vseobecneho strojirenstvi, Brno, Czechoslovakia

[21] Appl. No.: 909,344

[22] Filed: May 24, 1978

Related U.S. Application Data

[63] Continuation-in-part of Ser. No. 826,715, Aug. 22, 1977, abandoned.

[30] Foreign Application Priority Data

Aug. 24, 1976 [CS] Czechoslovakia ..... 5479/76

[51] Int. Cl.[2] ..... D03D 47/30

[52] U.S. Cl. ..... 139/435; 139/450; 139/194

[58] Field of Search ..... 139/116, 430, 435, 443, 139/450, 453, 194

[56] References Cited

U.S. PATENT DOCUMENTS

| | | | |
|---|---|---|---|
| 3,416,572 | 12/1968 | Giavini | 139/450 |
| 3,417,793 | 12/1968 | Freihofer | 139/194 |
| 3,482,606 | 12/1969 | Mizuno et al. | 139/435 |
| 3,658,098 | 4/1972 | Mullekom | 139/194 |
| 3,698,442 | 10/1972 | Sakamoto | 139/435 |
| 3,722,551 | 3/1973 | Mizuno et al. | 139/435 |
| 3,885,599 | 5/1975 | Mawdsley et al. | 139/435 |
| 4,078,586 | 3/1978 | Porter et al. | 139/450 |

FOREIGN PATENT DOCUMENTS

| | | | |
|---|---|---|---|
| 49-18506 | 5/1974 | Japan | 139/450 |

*Primary Examiner*—Henry Jaudon

[57] ABSTRACT

There are disclosed a method of and an apparatus for controlling weft threads, particularly in jet weaving machines with alternating insertion of two different wefts into a shed. At least during the inserting time of the first weft the end of the second weft inserted into the shed before said first weft is held and tensioned and is cut upon finishing the inserting operation of said first weft.

The apparatus for controlling wefts includes a pair of inserting jets and weft directing means with guides for each of the weft threads, weft traps being provided between the appurtenant nozzle and the weft directing means, for the purpose of trapping the appurtenant weft in the non-inserting position of the appurtenant inserting nozzle.

7 Claims, 6 Drawing Figures

METHOD OF AND APPARATUS FOR INSERTING WEFT THREADS INTO A JET LOOM

This application is a continuation-in-part of application Ser. No. 826,715, filed Aug. 22, 1977 now abandoned.

The present invention relates to a method of controlling weft threads in jet weaving machines provided with a mixing device, and to an apparatus for performing said method.

In jet weaving machines, the front end of the weft thread to be inserted must be drawn back as near as possible to the outlet opening of the nozzle. Upon this drawing back, the weft must be firmly gripped; however, this gripping must be temporarily released during weft insertion. An important condition of weaving with weft mixing in jet weaving machines is that the weft not being inserted is held and tensioned in a controlled manner as long as the insertion of the weft about to be inserted is not finished. Otherwise, the danger of a negative effect by the weft thread not to be inserted upon the weft thread to be inserted exists; this might cause a fault in the fabric.

In jet weaving machines which are not provided with weft mixing devices the device for controlling the weft thread during one operation cycle of the machine must perform the following series of operative steps:

weft insertion, i.e., opening and closing of the weft grippers;

back drawing of the weft from the shed, i.e. tensioning of the inserted weft;

cutting the weft; and back drawing of the cut weft end into the inserting elements, e.g., the nozzle.

Various methods of controlling two wefts have been proposed in which all the necessary operations set out above were not considered due to their intricacy. Furthermore, the just inserted weft was not tensioned and retained minimally until the moment of finishing the weft insertion of the next weft thread to be inserted. Those devices did not provide conditions permitting a reliable alternating insertion of two weft threads.

A weft controller is known which includes a stationary shaft, an annular segment mounted for oscillation on said shaft, a cam, a transmission mechanism for oscillating said annular segment, a first and a second long arm mounted swingably on said shaft and a resilient means mounted on both long arms in such manner as to hold them in V-shape on said shaft, stop means mounted on said annular segment in such manner as to cause a swinging motion of the long arms on the stationary shaft upon oscillation of said annular segment. It is obvious that the whole device, which is controlled by stops, operates with a high noise level, and that the impacts thus caused necessarily reduce the lifetime of the components thereof.

The said disadvantages and shortcomings are overcome to a considerable extent by the method according to the present invention and the device for performing said method, i.e., controlling wefts in jet looms provided with weft mixing devices for inserting weft of the same material. In accordance with such method, at least during the inserting time of the first weft, the end of the second weft inserted into the shed before said first weft is held and tensioned and is cut upon finishing the inserting operation of said first weft.

The apparatus for controlling wefts in accordance with the invention includes a pair of inserting jets and weft directing means with guides for each of the weft threads, weft traps being provided between appurtenant nozzle and the weft directing means for the purpose of trapping the weft in a non-inserting position of the respective inserting nozzle.

Further features of the apparatus of the invention are the controlling of the hook control by an independent cam, continuous motion of the apparatus without impacts and thus a more suitable treatment of the textile fiber, an independent motion of the hook and the grippers, and a longer lifetime of the components.

An embodiment of the present invention in form of a non-limiting example is shown in the accompanying drawings, in which.

Figure 1:
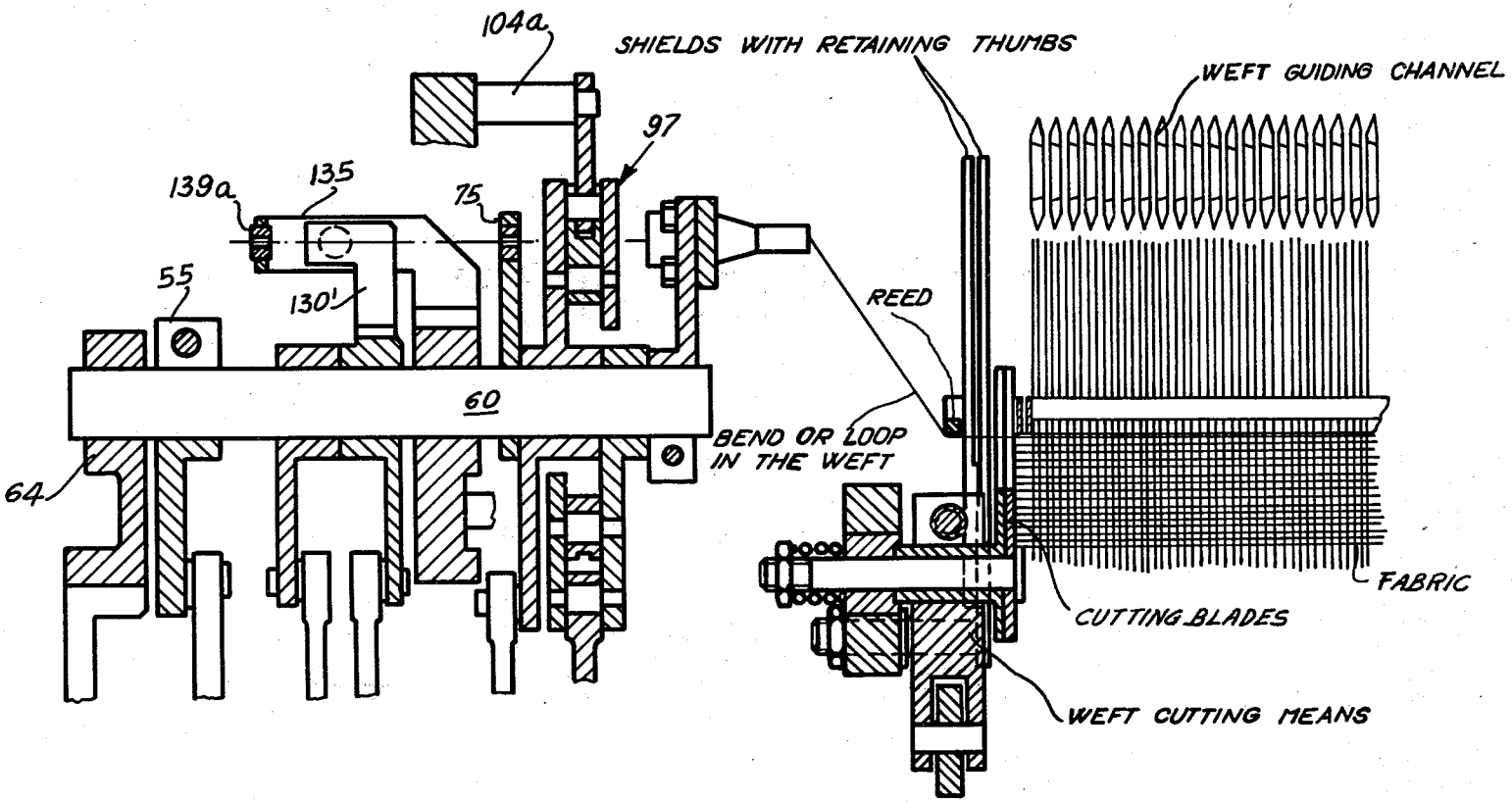
FIG. 1 is a fragmentary view, partially in end elevation and partially in vertical section, of the apparatus fo the invention.
Figure 2:
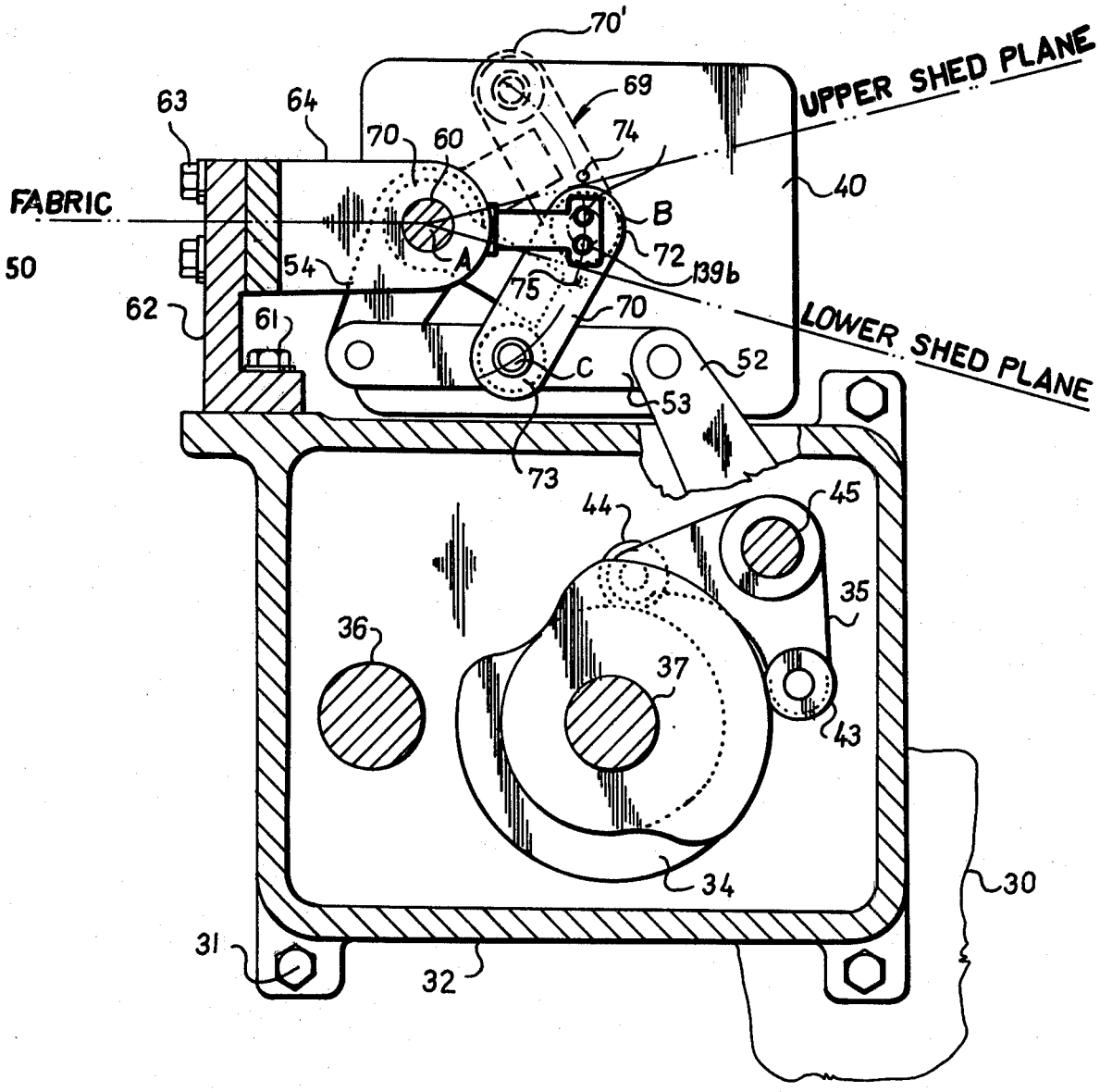
FIG. 2 is a view partially in side elevation and partially in section of the device for changing nozzles, the section being taken along line 2—2 of FIG. 3.
Figure 3:
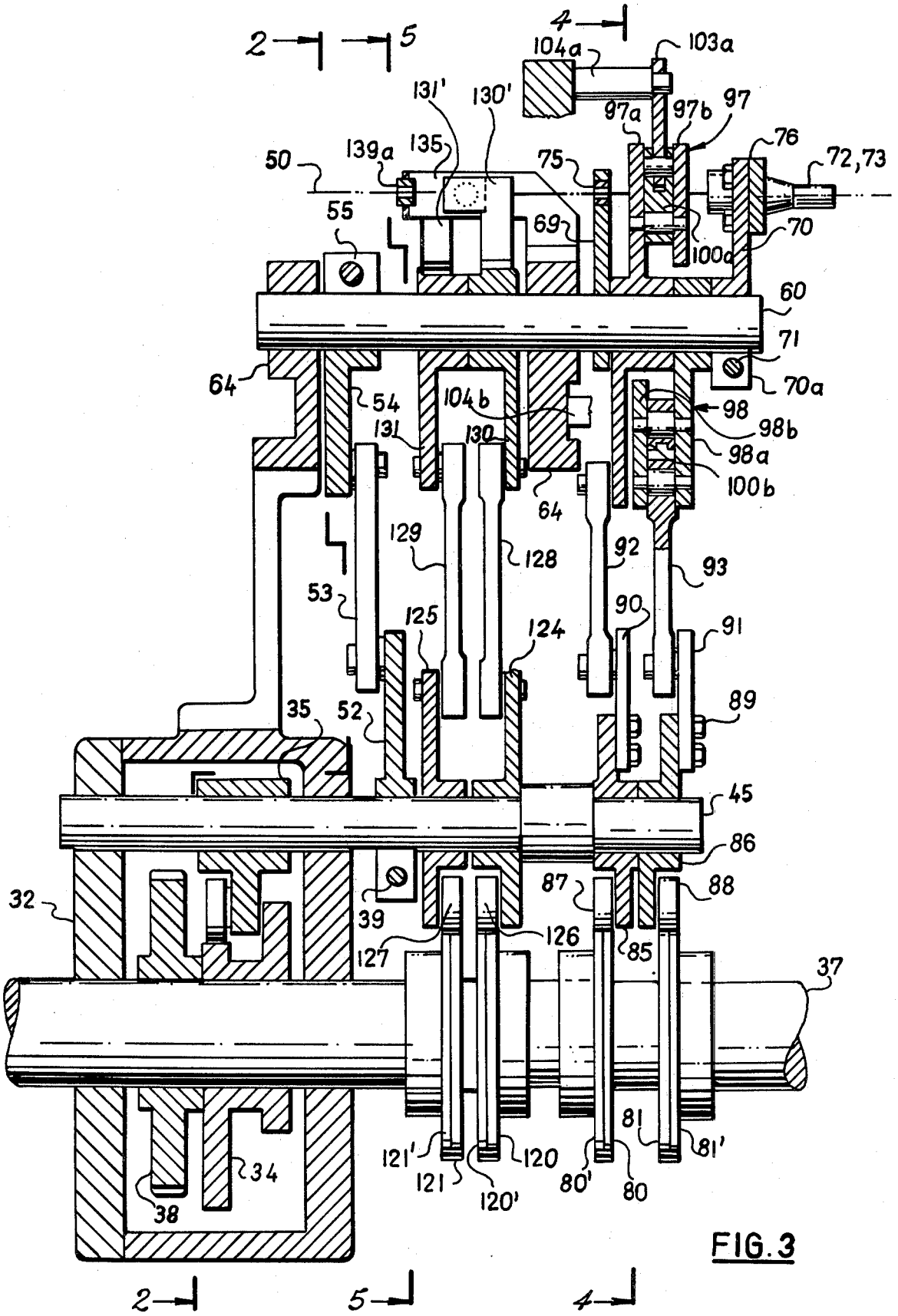
FIG. 3 is a view partially in front elevation and partially in section of the device for changing nozzles.

Turning now to FIGS. 1-3, incl., the weft control device is located between a weft magazine 40 on the one hand and the jetting device, the reed, and the inserting channel on the other.

THE NOZZLE MOVING MECHANISM

On the machine frame 30 which is fragmentarily shown in FIG. 2 there is fastened a housing 32 by means of screws 31. Within the housing 32 there are mounted parts of the weft controller of the invention. A main shaft 36 and a cam shaft 37 parallel thereto are journalled in the housing, the cam shaft being driven from the main shaft by a gear transmission, one gear 38 of which is shown in FIG. 3, the cam shaft 37 rotating at half the speed of the main shaft 36. A cam 34 for moving the weft inserting nozzles 72, 73, is affixed to the cam shaft 37. Motion is transmitted from the cam 34 to the nozzles 72, 73 by means of cam follower rollers 43 and 44 which are mounted on the ends of the respective arms of a two-armed lever or lifter 35 which is fixedly mounted upon countershaft 45 disposed parallel to the main shaft 36 and the cam shaft 37, the lifter 35 oscillating the countershaft 45 as the cam shaft 37 rotates. A lever 52 is connected to countershaft 45 by a clamping connection 39, the outer end of lever 52 being connected to the outer end of a lever 54 by a tie rod or link 53 which is pivotally connected to said levers. Lever 54 is fixedly connected to an output shaft 60, disposed parallel to shaft 36, 37, and 45, by a clamping connecting means 55. It will be seen that the output shaft 60 oscillates in synchronism with the oscillation of the countershaft 45.

Figure 5:
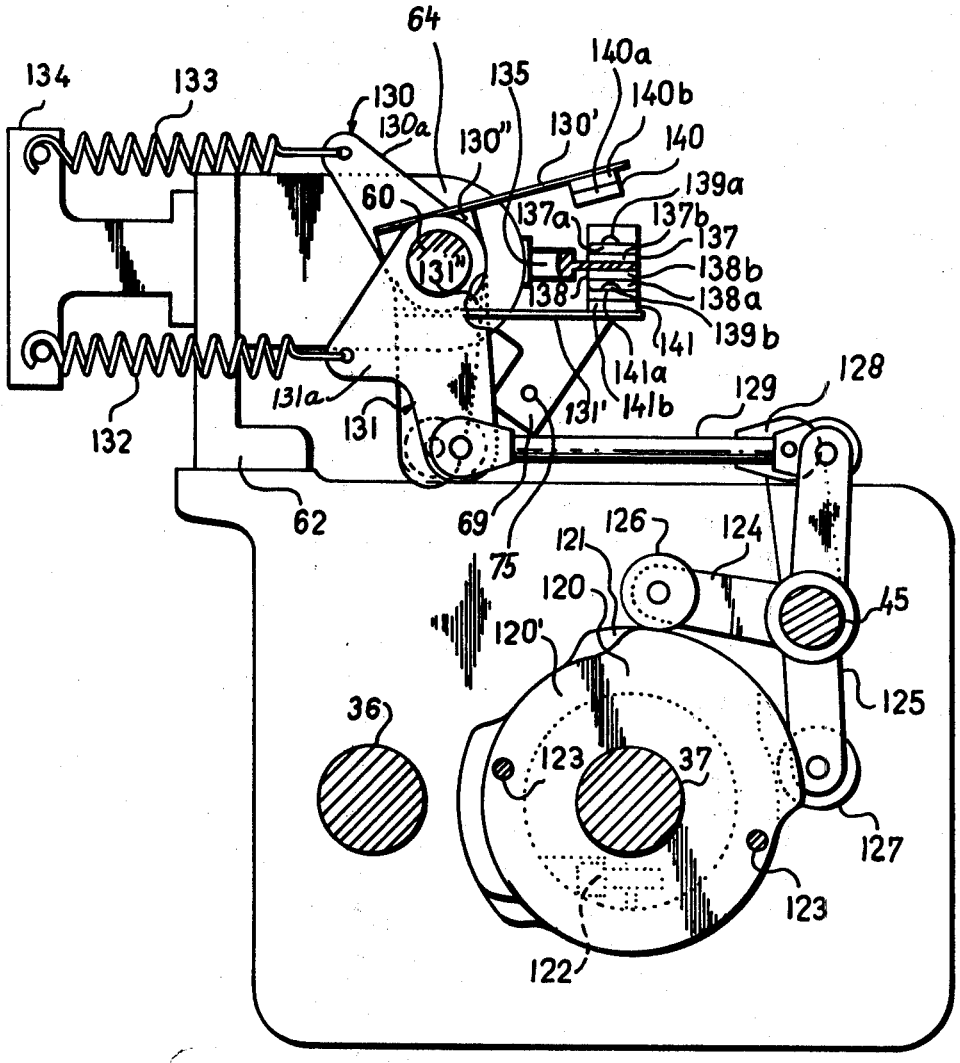
FIG. 5 is a view partially in side elevation and partially in section of the weft gripper, the section being taken along the line 5—5 of FIG. 3.

The weaving plane of the loom is designated 50 in FIGS. 2 and 3. As shown, the output shaft 60 is disposed with its axis on the weaving plane, the output shaft 60 being supported for oscillating in supports mounted upon the housing 32. One such support, shown in FIGS. 2 and 3, includes an L-shaped upright 62, attached to the housing by screws of which one is shown at 61, there being a horizontally extending member 64, in which the output shaft 60 is journalled, secured to the upright member 62 by screws 63. The member 62 is provided with slots (not shown) through which the screws 61 and 63 extend, so that it may be adjusted in a direction parallel to the weaving plane 50 and in a direction perpendicular to such plane. A weft directing means 69, which is provided with an upper weft guiding eyelet 74 and a lower weft eyelet 75, is firmly affixed to the output shaft 60 (FIG. 5). A holder 70 for the weft inserting nozzles 72 and 73 is affixed to the output shaft 60 by a clamping connecting means 70*a* which is tightened by a screw 71. As shown in FIG. 2, the nozzle holder 70 is of T shape, the nozzles 72 and 73 being disposed at opposite ends of the head of the member 70. The holder 70 is oscillated between the solid-line lower position thereof shown in FIG. 2 and the upper dash-line position thereof wherein it is designated 70'.

As shown, the nozzles 72, 73 are disposed on a circle which is coaxial of the axis A of the output shaft 60.

The eyelets 74, 75 of weft directing means 69 are disposed in such manner that their centers lie on the same circle as nozzles 72 and 73. The gripping connection 70*a* between the nozzle holder 70 and the shaft 60 permits the nozzle holder to be adjusted about the shaft 60 to permit the nozzles 72, 73 to be suitably aligned with respect to the weft guides 74 and 75. The output shaft 60 is so disposed that its axis A coincides with the fell of the loom. The previously described adjustments of member 64 with respect to member 62, and of member 62 with respect to the housing 32 permits the shaft 60 to be disposed as described.

Nozzles 72, 73 are fastened to holder 70, for example, by means of a spectacle-shaped sleeve, which makes it possible easily to change the nozzle upon a change in the weft material being used.

In FIG. 2 weft inserting nozzle 72 is shown in the weft inserting position B and nozzle 73 is shown in its lower, non-inserting position C. The points A, B, and C preferably form an equilateral triangle. With an angle of oscillation of output shaft 60 of 60°, and with the axis A of the shaft 60 congruent with the binding point, the motion of weft inserting nozzles 72 and 73 is such that when one nozzle is moved from the weft inserting position to its non-inserting position the weft is drawn back from the shed and the weft after insertion is tensioned. Furthermore, drawing back of the cut weft yarn end into the nozzle is achieved.

THE WEFT RETAINER

Figure 4:
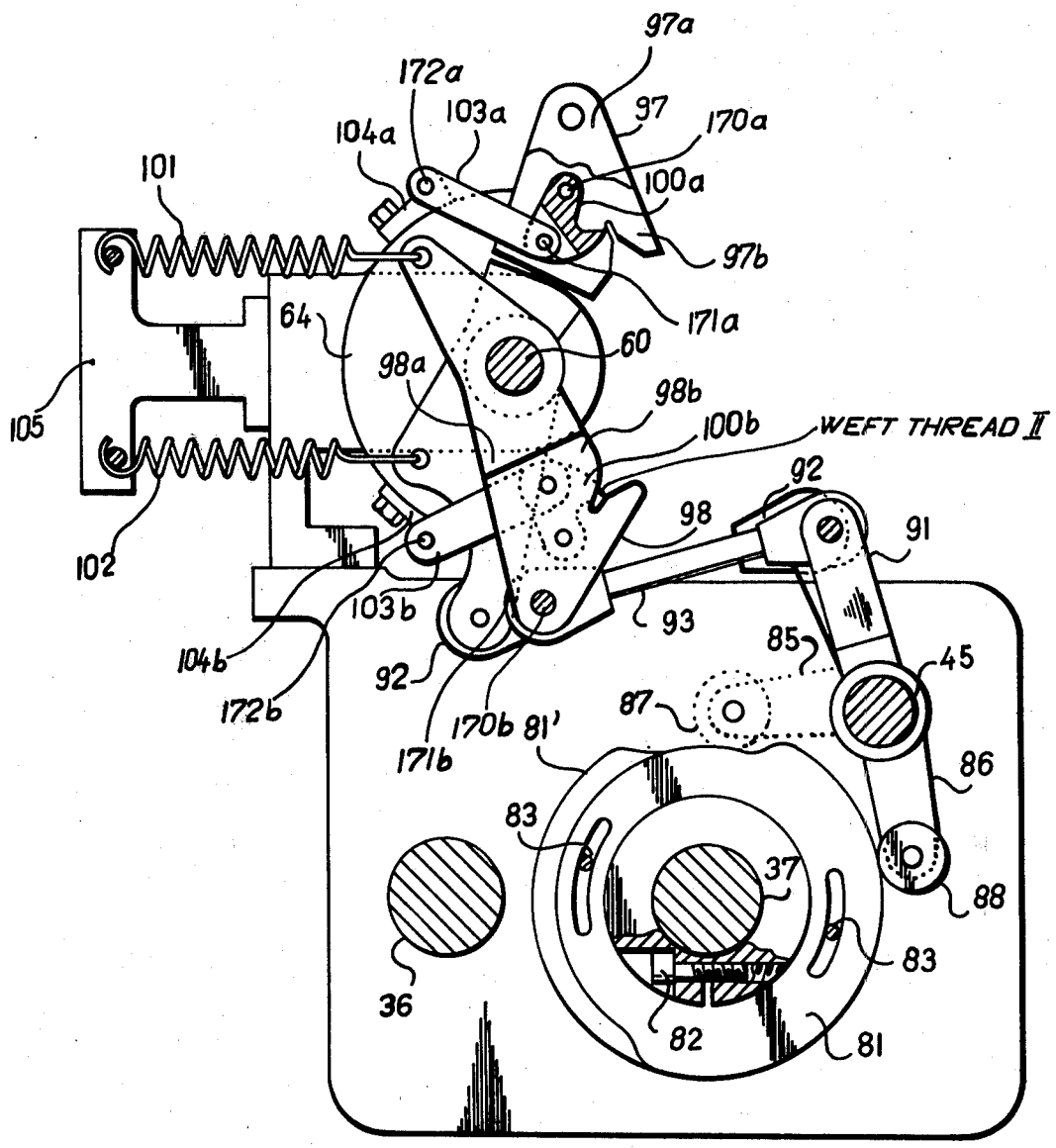
FIG. 4 is a view partially in side elevation and partially in section of the weft trap, the section being taken along the line 4—4 of FIG. 3.

Referring to FIGS. 3 and 4, on the cam shaft 37 there are mounted two cams 80 and 81 which are fastened to the shaft by means of screws 82 which permit the cams to be adjusted around the axis of shaft 37, so that the moment of retaining the weft can be adjusted. In order to permit adjustment of the time of retaining the weft, cams 80, 81 are divided and completed by parts 80', 81', respectively. By changing the angle of overlap of cam parts 80, 80' on the one hand and 81 and 81' on the other adjustment of the retainment time to attain that desired is achieved. Cam parts 80', 81', can be fastened to cams 80, 81, respectively, by means of screws 83, as shown.

On countershaft 45 there are pivotally mounted without the possibility of sidewise shifting two two-arm levers 85, 86. On each arm of each lever 85, 86 there are mounted cam following rollers 87, 88, respectively, which are in contact with cams 80, 81 of the retainer mechanism. The length of the upper arms (FIG. 3) of levers 85, 86 can be adjusted by providing each such arm with a separate extension 90, 91, respectively, parts 90, 91 being connected to the upper lever arms of levers 85 and 86 by slot and screw connections 89, which permit the effective lengths of such upper arms of levers 85, 86 to be suitably adjusted.

Tie rods or links 92 and 93 are pivotally connected to the upper ends of lever arms 90 and 91, respectively, the upper ends of links 92 and 93 being pivotally connected to weft retainers 97 and 98, respectively. Retainers 97, 98 are mounted on shaft 60 for free rotation with respect thereto. As shown in FIG. 3, the upper retainer 97 is a two-arm lever, the lower arm of which is pivotally connected to link 92. The lower retainer 98 is also a two-armed lever, the lower arm of which is pivotally connected to the upper end of link 93. A coil tension spring 102 disposed between a spring bracket 105 and the lower arm of the upper retainer 97 retains the roller 87 in firm contact with the cam 80, 80'. A similar coil tension spring 101 is disposed between the spring bracket 105 and the upper arm of the lower retainer to maintain the cam following roller 88 in firm engagement with its cam 81, 81'.

As shown in FIG. 3, the upper arm of the upper weft retainer 97 is formed by two introducing shields 97*a*, 97*b*. Between shields 97*a* and 97*b* there is rotatably mounted a weft retaining hook 100*a*. The hook arm of the lower retainer 98 likewise carries two shields designated 98*a* and 98*b*, there being a rotatable weft retaining hook 100*b* mounted between the shields 98*a* and 98*b*. As shown in FIG. 4, the retaining hook 100*a* is pivotally connected to one end of a link 103*a*, the other end of such link being pivotally connected to a bracket 104*a* which is fixedly mounted upon the frame of the apparatus. Also as shown in FIG. 4, the retaining hook 100*b* on the lower retainer 98 is pivotally connected to one end of a link 103*b* by means of joint 171, the other end of such link being pivotally connected to a bracket 104*b* connected by means of a joint 172*b* to the member 64. The retaining hook 100*a* which is pivotally mounted on the upper retainer 97, is pivotally mounted to one end of a link 103*a* by means of joint 171*a*, the other end of such link being pivotally mounted to a bracket 104*a* by means of a joint 172*a* mounted upon the body 64. The brackets 104*a* and 104*b* are mounted on body 64 for adjustment about the axis of the shaft 60. It will be apparent that the retaining hooks are swung about their mounting pivots 170*a*, 170*b* on the respective weft retainers 97, 98 as such retainers are oscillated around shaft 60.

The links 92 and 93 are preferably made adjustable as to their lengths; for simplicity of illustration such adjusting means are not shown in the drawings. By changing the effective lengths of the upper arms of levers 85, 86 the swinging motion of the upper and lower weft retainers 97, 98 is changed. By changing the lengths of the adjustable tie rods or links 92, 93, the position of weft retainers 97, 98 is changed.

The upper weft retainer 97, the retaining hook 100*a*, and the tie rod 103*a* together form a four-joint mechanism, of which the pitman is the closing hook 100*a* and the balance beams the upper retainer 97 and the tie rod 103*a*.

The lower retainer 98, the retaining hook 100*b*, and the tie rod 103*b* together form a four-joint mechanism, of which the pitman is the closing hook 100*b* and the balance beams the lower retainer 98 and the link or tie rod 103*b*.

The balance beams of the mechanisms of the retainers 97, 98 are mounted on the output shaft 60, the other balance beams, that is, links 103*a*, 103*b*, are mounted on brackets 104*a*, 104*b* on the circumference of the circular part of body 64 which journals output shaft 60. The circular part or body 64 is coaxial with the output shaft 60.

THE WEFT GRIPPING MECHANISM

Referring now to FIGS. 3, 4, and 5, two cams 120, 121 for driving the weft gripping mechanism are mounted on the cam shaft 37. Such cams are adjustably mounted upon the cam shaft by gripping mechanisms incorporating thightening screws 122. This permits the moment of the gripping of the weft to be adjusted. In order to provide for an adjustment of the duration of the gripping of the weft, cams 120 and 121 are made in two parts, the parts 120' and 121' being angularly adjustable with respect to the cams 120, 121, respectively, the parts of each cam being fastened together by screws 123 threaded into one part of the cam and extending through arcuate slots in the other part thereof. By changing the degree of overlapping of the parts of the respective cams, the required duration of weft gripping is attained.

On countershaft 45 there are pivotally mounted without the possibility of sidewise shifting levers 124, 125. On one arm of each lever 124, 125 there is mounted a roller 126, 127, respectively, the rollers being in permanent contact with the cams 120, 121. The other arm of each of levers 124, 125 transmits motion from the cam follower by way of pivotally mounted links 128, 129 to the weft grippers 130, 131 (FIG. 5) which are mounted on output shaft 60 for free rotation with respect thereto. The weft grippers 130, 131 are formed as respective assemblies, each operated by its respective mechanism. Both gripper assemblies are mounted on shaft 60.

The upper gripper 130 (FIG. 5) has an upstanding lever 130*a* the upper end of which is connected to one end of a coil tension spring 133, the other end of such spring being connected to a bracket 134 which is fastened to the L-shaped body 62. The spring 133 ensures constant engagement between roller 126 and cam 120.

Intermediate the length of the lever 131*a* of the lower gripper 131 (FIG. 5) there is connected one end of a coil tension spring 132, the other end of the spring being fastened to the spring bracket 134. Spring 132 ensures constant engagement between roller 127 and gripper operating cam 121.

Affixed to the member 64 which journals the shaft 60 there is a bracket 135 (FIG. 3), elements 137*a*, 137*b*, and 138*a*, and 138*b* of stationary gripper members 137, 138, respectively, being fastened to bracket 135. Elements 137*b*, 138*b* are advantageously made of resilient material such as rubber and the like, and elements 137*a*, 138*a* are made in the form of metal plates.

Fastened to the carrying parts 130', 131', of the movable grippers 130, 131, respectively, are movable grippers 140, 141. The elements 140*b*, 141*b* of the movable grippers are advantageously made of resilient material such as rubber and the like and the elements 140*a*, 141*a* are made in the form of metal plates. The fastening of the grippers 140, 141 to the carrying parts 130', 131' is advantageously formed as a demountable gripping connection. On the bracket 135 of the stationary gripper there are fixed two stationary eyelets 139*a*, 139*b*, the axes of which are directed parallel to the axis of the weft inserting nozzle (72 or 73) which is disposed in the inserting position B.

The grippers 130, 131 are advantageously made in such manner that they are constituted of carrying parts 130', 131' and of bodies 130'', 131'' which are mutually connected by a gripping connection (not shown) which is demountable. Thus the relative position of parts 130' and 131'' can be adjusted, so that the pressing of resilient elastic elements 137*b*, 138*b* and 140*b*, 141*b* at the moment of gripping a weft by metal plates 137*a*, 140*a*, or 139*a*, 141*a*, may be changed.

When the device is used in a loom in which the weft is guided through the shed, e.g., by means of an inserting or guiding channel, and the position of the inserting elements, e.g. nozzles 72, 73 depends in the inserting position upon the axis of said inserting channel, the center of nozzle 72 or 73 is adjusted into the required inserting position by means of adjusting the gripping connection which fastens lever 54 to shaft 60. Such adjustment is made possible because the upper retainer 97, the lower retainer 98, the upper weft gripper 130, and the lower weft gripper 131 are adjustably mounted on the output shaft 60. At the same time, it is necessary to adjust the position of the weft cutting point relative to the axis of output shaft 60.

The above-described apparatus according to the present invention operates as follows:

Two different weft threads, hereinafter called wefts I and II, respectively, are delieved from the magazine 40 (FIG. 2) for measured weft lengths, and are guided, respectively, in two stationary eyelets 139*a*, 139*b* of the weft grippers, weft I for example, passing through gripper 130, and weft II passing through gripper 131. The wefts are further guided in guides 74, 75 of the directing means 69 and the inserting elements, here made in the form of nozzles 72, 73.

Before starting the machine, it is necessary to grip the wefts I, II by both pairs of gripping elements 137*a*, 140*a* and 138*a*, 141*a*. This condition is maintained except when one of the nozzles 72, 73 is in the inserting position B of the loom. Thus, for example, weft II is further guided by the lower retainer 98 into the space of the cutting point of the weft cutting means (FIG. 1). The weft cutting means shown may be that disclosed in Malasek et al application Ser. No. 861,880, filed Dec. 19, 1977, which is incorporated herein by reference in its entirety. Weft I is guided, in turn, to the cutting point by the upper retainer 97. This may be achieved in several manners, for example, by a control button for the machine cycle, or by the unravelling device of the loom. If said operations cannot be performed in the loom, this is achieved by the manual control of the cycle or by the manual directing of the weft thread.

Figure 6:
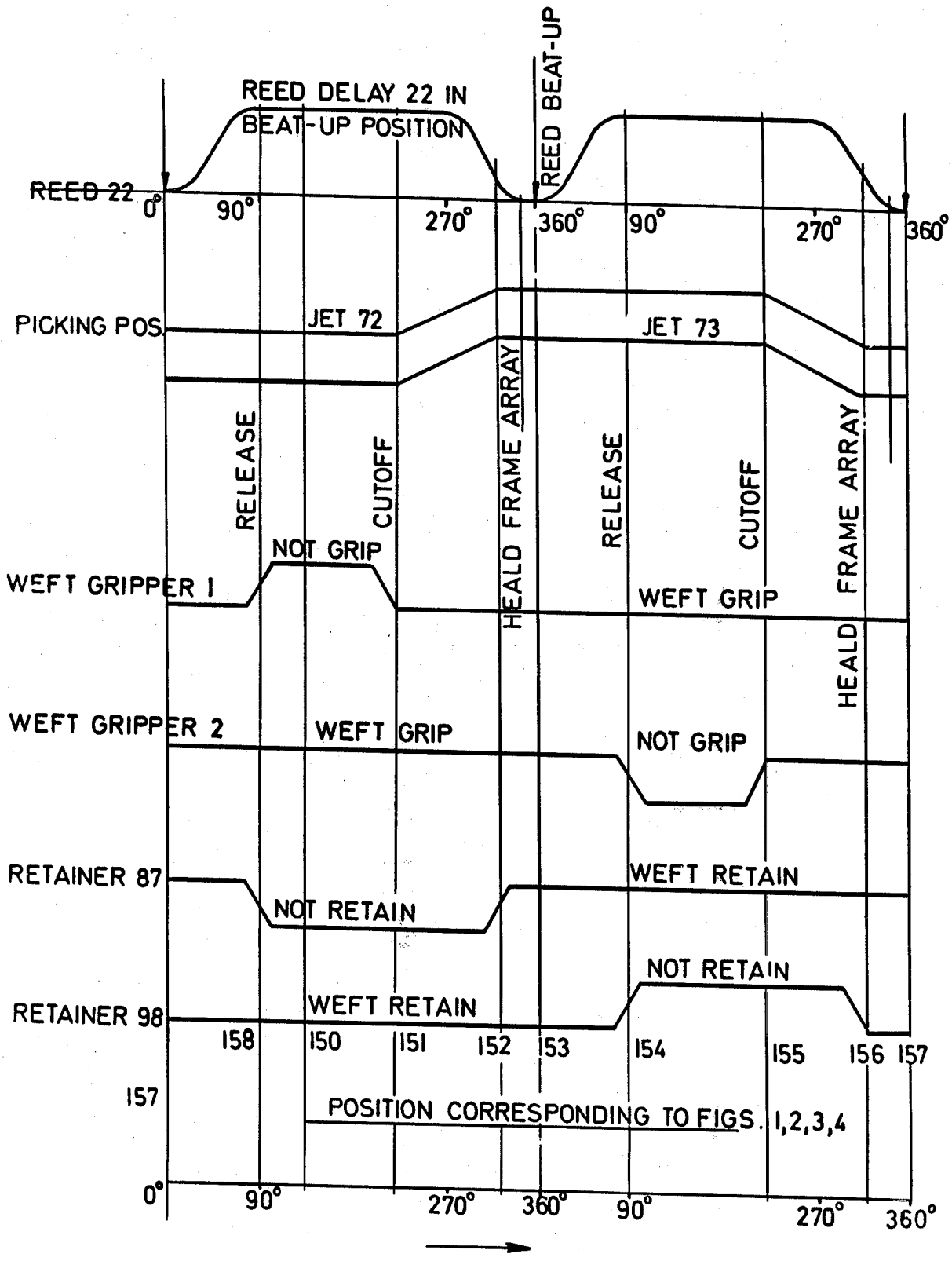
FIG. 6 is a graphical representation of the operation cycles of the weft control apparatus according to the present invention.

Now it is possible to start the loom. The initial position (FIG. 6) is denoted 150. In FIG. 6 the various parts of the loom are assumed to be in the positions shown in FIGS. 2, 3, 4, and 5. As noted, the upper branch or weft set is called weft I. Weft I is operated upon by the upper nozzle 72, the upper gripper 130, and the upper retainer 97. Also, as noted, the lower branch or weft set is called weft II. Weft II is operated upon by the lower nozzle 73, the lower gripper 131, and the lower retainer 98. The operation depicted in FIG. 6 proceeds in the direction from left to right, the horizontal coordinate representing the degrees of turning of the cam shaft 37 from an assumed zero position.

POSITION 150

This position is the inserting position of weft I. The weft gripper 130 does not grip weft I, the retaining hook 100*a* of upper retainer 97 does not hold weft I. The weft gripper 131 grips weft II, the closing hook of the lower retainer 98 holds weft II which is not cut, but which is held by the retaining thumb of the weft cutting means at the cutting point A. The apparatus remains in that position during the whole time of insertion of weft I, until position 151 is reached.

POSITION 151

This position represents the termination of insertion of weft I. Weft gripper 130 grips weft I, otherwise the operation in this position is the same as in position 150.

POSITION 151–152

Weft I

Weft I, which is gripped by weft gripper 130, is tensioned by movement of the nozzle 72 from the inserting position into its non-inserting position and is drawn back from the shed, the drawing back of the weft to the nozzle being effected by means of a coincident movement of the nozzle 72 and the unit 69. Means 69 and 72 move synchronously and in a common plane. The length of the weft I drawn from the shed can be changed by the initial adjustment of the position of retainer 97, which is in the path of the weft I which is tensioned and drawn from the shed, in the space between the directing means 69 and nozzle 72, thus forming an adjustable bend or loop of weft I about the grooves in the introducing shields of retainers 97 and 98. Means 69 and 72 move together, because both are fixedly secured to shaft 60. At that moment, retainer 97 is in motion, that is, it swings out in the direction of movement of the change of nozzles 72 and 73. The swinging motion of retainers 97, 98 causes the grooves in the introducing shields to be closed and determines by hook 100*a*, 100*b* the extent of the swinging motion of retainer 97, thus determining the length of the drawing of weft I into nozzle 72.

Special attention is to be paid to the bend or loop (FIG. 1) formed in weft I. This is actually a loop formed in the weft thread with an adjustable length. The properties of the four-joint mechanism consisting of upper retainer 97, closing hook 100*a* and tie rod 103*a* mounted on bracket 104*a* make possible the changing of the length of the loop.

As noted above, drawing back the weft to the nozzle is not effected by the retainer 97, but by means of a coincident movement of the nozzle and the unit 69. Both these elements move synchronously and in a common plane. After the loosening of the retaining means formed by the retainer 97 and the hook 100*a* (or by the retainer 98 and the hook 100*b*), just in the moment of the beginning of insertion, the loop of weft is loosened, thus securing a perfect course of insertion.

Weft II

Nozzle 73 is moved from the non-inserting position into the inserting position. At the moment of tensioning of the weft II, which is caused by the motion of nozzle 73, weft II is cut upon being held by retaining hook 100*b* of retainer 98. Further, weft II is gripped by gripper 131. The movement of nozzle 73 from the non-inserting position into the inserting position causes the end of cut weft II to be drawn back into nozzle 73. As the length of the cut weft end II is the same as the path of movement of nozzles 72 and 73 (see the equilateral triangle A, B, C described above), the whole length of the cut end of weft II will be drawn into the nozzle. Actually, this length is also adjustable, as explained below.

Meanwhile, the reed moves into the beat-up position and the she is closed. The movement of nozzles 72 and 73 must be finished before the shed is closed.

POSITION 153

The reed has reached the beat-up position and has transferred the inserted uncut weft I into the fell or binding point A (FIG. 2). As the distance between nozzle 72 in the non-inserting position and the inserting position, and further the distance between nozzle 72 in the non-inserting position and the binding point (or possibly the cutting point), is equal—see the equilateral triangle ABC—weft I is not overtensioned. Weft I is held in the space of the cutting point by a retaining thumb of the cutting device, without being cut. Weft II preserves the position which it had in position 152. Both wefts remain in this position until position 154 is reached.

POSITION 154

The reed is in the inserting position, a new shed is opened. Weft II is begun to be inserted. At first, the lower retainer 98 is brought into motion. Thus, weft II is released, but hook 100*b* is not closed. In that manner, the length of cut weft II is adjusted to its optimum value in front of nozzle 73 in the inserting position. An exact adjustment of such length is made possible by the adjustment of bracket 104*b* about the circumference of the circular part of member 64 which journals the output shaft 60, such adjustment determining the extent of swinging motion of the lower retainer 98. In a further part of the swinging motion of lower retainer 98, the groove in the introducing shields of the retainer is opened by hook 100*b* and simultaneously, weft II is released by gripper 131. Thereupon, insertion of weft II takes place. Weft I is in the same position as in position 152.

POSITION 155

The insertion of weft II is finished. The gripper 131 grips weft II. Weft I is in the same position as in position 152.

POSITION 155–156

Weft II, which is gripped by weft gripper 131, is drawn out of the shed by movement of nozzle 73 from the inserting position into a non-inserting position, and is tensioned. The length of weft II drawn back from the shed can be changed by changing the initial position of lower retainer 98, which is in the path of a tensioned weft II which is drawn out of the shed, thus forming a bend or loop in weft II about the grooves in the introducing shields 98*a*, 98*b*. At that moment, the lower retainer 98 begins to move, that is, to swing out in the direction of movement of changing the nozzles 72 and 73. The swinging motion of the lower retainer 98 causes a closing of the grooves in the introducing shields 98*a*, 98*b* by hook 100*b*. All that was said above about the forming of a bend or loop in weft I applies to the forming of a bend or loop in weft II.

Weft I

Nozzle 72 starts moving from the non-inserting position into the inserting position. At the moment of the tensioning of weft I, caused by the movement of nozzle 72, weft I is cut and is held by retaining hook 100*a* of retainer 97. Further, weft I is gripped by gripper 130. By the movement of nozzle 72 from the non-inserting position into the inserting position, the end of cut weft I is drawn back into nozzle 72. This length is adjustable in the same manner as in the case of weft II, described above.

Meanwhile, the reed moves into the beat-up position and the shed is then closed. The movement of nozzles 72 and 73 must be finished before the shed is closed, i.e., the healds are arranged behind each other in a row, all at the weaving level.

POSITION 157

The reed has reached the beat-up position and has brought the inserted, uncut weft II to the binding point A (or possibly to the cutting point). As the distance between nozzle 73 in the non-inserting position and the inserting position, and also the distance between nozzle 73 in the non-inserting position and the binding point A (or possibly the cutting point) is equal (see the equilateral triangle ABC), weft II is not overtensioned. Weft II is held in the space of the cutting point by a retaining thumb of the cutting device in uncut condition. Weft I remains in the same position which it assumed upon reaching position 156. Both wefts remain in this position until position 158.

POSITION 158

The reed is now in an inserting position, a new shed has been opened. The insertion of weft I is started. First, the upper retainer 97 starts moving. Thus, weft I is released, but hook 100*a* remains closed. In that manner, the cut length of the end of weft I to be cut is adjusted to its optimum value in front of nozzle 72 in its inserting position. An accurate adjustment of that length is made possible by the adjustment of the bracket 104*a* about the circumference of the circular part of the body 64 which journals output shaft 60 to determine the extent of swinging motion of the upper retainer 97. In the further part of the swinging motion of the upper retainer 97, the groove of introducing shields 97*a*, 97*b* is opened by hook 100*a* and weft I is simultaneously released by gripper 130. The insertion of weft I then takes place. Weft II preserves the same position that it had in position 156. One cycle of operations of the weft control apparatus in accordance with the invention for jet looms provided with a weft mixing device is now finished.

Although the invention is illustrated and described with reference to a single preferred embodiment thereof, it is to be expressly understood that it it in no way limited by the disclosure of such single embodiment, but is capable of numerous modifications within the scope of the appended claims.

What is claimed is:

1. A method of controlling weft threads in jet looms which operate with alternation of insertion of different first and second weft threads, comprising the following steps in the order named: opening a first shed of the loom, inserting the first weft thread into the first shed, beating up the inserted first weft thread, closing the first shed, retaining the inserted first weft thread in uncut condition under tension, opening a second, subsequent shed, inserting the second weft thread into the second shed, beating up the inserted second weft thread, retaining the inserted second weft thread under tension, and cutting off the first weft thread.

2. Apparatus for controlling weft threads in jet looms which operate with alternation of insertion of measured lengths of different first and second weft threads, said apparatus having a weft cutting mechanism, comprising a gripping mechanism for each weft thread, a pair of inserting nozzles mounted so that each nozzle alternately moves into an inserting and a non-inserting position, directing means with guides for each weft thread, the inserting nozzles and the directing means being arranged for swinging about a common axis, the inserting nozzles and directing means being disposed between the weft cutting mechanism and the gripping mechanism, and weft thread retainers arranged between the respective nozzle and weft thread directing means for retaining the respective weft thread when its nozzle is in a non-inserting position.

3. Apparatus as claimed in claim 2, wherein the loom has a main shaft and an output shaft, the pair of inserting nozzles and directing means for the weft threads are adjustably arranged on the output shaft, the output shaft being journalled in a member which is displaceable relative to the stationary parts of the loom, the output shaft being positively oscillated by the main shaft through the intermediary of a transmission.

4. Apparatus as claimed in claim 3, wherein the axis of the output shaft is directed towards the binding point of the fabric and forms an isosceles triangle together with the axis of each of the nozzles in its inserting position and the axis of the nozzle in its non-inserting position.

5. Apparatus as claimed in claim 4, wherein the isosceles triangle is an equilateral triangle.

6. Apparatus as claimed in claim 4, wherein the retainers of the weft threads are mounted swingably on the output shaft, each retainer has at least one introducing shield and a retaining hook, and the retainers are driven from the main shaft of the loom.

7. Apparatus as claimed in claim 6, wherein each retainer is formed by two introducing shields between which there is swingably mounted a retaining hook which is connected by a tie rod to a stationary part of the loom, said introducing shields being swingably mounted on the output shaft and being driven from the main shaft of the loom.

* * * * *